US005517171A

United States Patent [19]

Kotani et al.

[11] Patent Number: 5,517,171

[45] Date of Patent: May 14, 1996

[54] HIGH-VOLTAGE ELECTRONIC COMPONENT

[75] Inventors: Hirokazu Kotani, Yatsuo; Hiromasa Saikatsu, Himi; Hitoshi Ishiwari, Toyama; Kenichi Hiraki, Inami, all of Japan

[73] Assignee: Hokuriku Electric Industry Co., Ltd., Toyama, Japan

[21] Appl. No.: 214,817

[22] Filed: Mar. 17, 1994

[30] Foreign Application Priority Data

Mar. 17, 1993 [JP] Japan ..... 5-011868 U

[51] Int. Cl.[6] ..... H01C 10/30; H01C 13/00

[52] U.S. Cl. ..... 338/118; 338/193; 338/128; 338/219; 338/273; 338/184; 338/322

[58] Field of Search ..... 338/118, 219, 338/193, 273, 128, 274, 322, 184, 199, 277

[56] References Cited

U.S. PATENT DOCUMENTS 4,402,037 8/1983 Iwamura et al. ..... 338/219 X
4,471,339 9/1984 Fukada et al. ..... 338/184 X

FOREIGN PATENT DOCUMENTS 4016521A 11/1991 Germany ..... 338/315
62-192601 8/1987 Japan ..... H01C 13/00

OTHER PUBLICATIONS

Japanese Utility Model Application Laid–Open Publication No. 6/1991.
Japanese Utility Model Application Laid–Open Publication No. 32504/1992.

*Primary Examiner*—Marvin M. Lateef
*Attorney, Agent, or Firm*—Pearne, Gordon, McCoy & Granger

[57] ABSTRACT

A high-voltage electronic component including a terminal connection structure capable of connecting a lead wire to a terminal fitment without soldering. An insulating substrate having a resistance element for a variable resistor formed on a front surface thereof and a high-voltage resistor are received in a hollow insulating casing. The insulating substrate is mounted on a rear surface thereof with a terminal fitment. The terminal fitment is formed with a press-fit channel in which a lead wire is press-fitted. Upon press fitting of the lead wire, the insulating casing is formed with an opening, through which insulating resin is charged in the insulating casing to form an insulating resin layer in which the terminal fitment and lead wire are embedded.

10 Claims, 4 Drawing Sheets

HIGH-VOLTAGE ELECTRONIC COMPONENT

BACKGROUND OF THE INVENTION

This invention relates to a terminal structure for an electronic component for a high voltage, and more particularly to a terminal structure for a high-voltage variable resistor unit for a high voltage.

An electronic component for a high voltage (hereinafter referred to as "high-voltage electronic component") typically includes a high-voltage variable resistor unit commonly called a focus pack which is used for controlling a focus voltage or a screen voltage of a cathode ray tube (CRT) for a TV or the like. Such a high-voltage variable resistor unit is so constructed that an insulating substrate having a terminal fitment fixed on a rear surface thereof is received in an insulating casing and is covered at the rear surface thereof with a layer of an insulating resin material. The terminal fitment is constructed so as to permit each of lead wires of an attached electronic component received in the insulating casing and lead wires led out therefrom to be connected thereto.

Conventionally, the lead wires each are generally connected, by soldering, to an end of the terminal fitment projected from the insulating resin layer.

For example, Japanese Utility Model Application Laid-Open Publication No. 6/1991 discloses a high-voltage variable resistor unit which is so constructed that each of lead wires is connected, by soldering, to an end of a terminal fitment projected from an insulating resin layer.

Also, Japanese Utility Model Application Laid-Open publication NO. 32504/1992 discloses another high-voltage variable resistor unit in which a first insulating substrate provided on an upper surface thereof with a variable resistance pattern is received in a substrate receiving chamber of an insulating casing and a second insulating substrate provided on an upper surface thereof with a fixed resistance pattern is received in another substrate receiving chamber of the insulating casing while being fixed on a holder. The first insulating substrate is formed on a rear surface thereof with an insulating resin layer and provided on the rear surface thereof with a terminal fitment in a manner to be projected at an end thereof from the insulating resin layer. The second insulating substrate fixed on the holder has a lead wire provided thereon so as to extend directly therefrom, which is connected at an end thereof to the end of the terminal fitment projected from the insulating resin layer, by soldering.

It is required that a high-voltage electronic component is constructed so as to minimize soldering in order to simplify the manufacturing and minimize a failure in connection. It would be considered to use a connector in order to eliminate soldering. Unfortunately, use of the connector causes an increase in number of parts used and manufacturing cost.

SUMMARY OF THE INVENTION

The present invention has been made in view of the foregoing disadvantage of the prior art.

Accordingly, it is an object of the present invention to provide a high-voltage electronic component including a terminal connection structure which is capable of permitting a lead wire to be connected to a terminal fitment without soldering.

It is another object of the present invention to provide a high-voltage electronic component which is capable of substantially preventing a lead wire from being disconnected from a terminal terminal without soldering.

It is a further object of the present invention to provide a high-voltage electronic component which is capable of facilitating connection of a lead wire to a terminal fitment.

In accordance with the present invention, a high-voltage electronic component is provided. The high-voltage electronic component includes an insulating substrate having a front surface and a rear surface and formed on the front surface thereof with a circuit pattern and a one-side-open insulating casing of a hollow shape which is formed on one side thereof with an opening. The insulating substrate is received in the insulating casing in such a manner that the rear surface of the insulating substrate faces the opening of the insulating casing. The high-voltage electronic component also includes an insulating resin layer formed on the rear surface of the insulating substrate received in said insulating casing and a terminal fitment fixed on the rear surface of the insulating substrate and electrically connected to the circuit pattern. The terminal fitment is formed with a press-fit channel in which a lead wire is press-fitted at an end thereof and the end of the lead wire is embedded in the insulating resin layer while being kept press-fitted in the press-fit channel.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENT

Figure 1A:
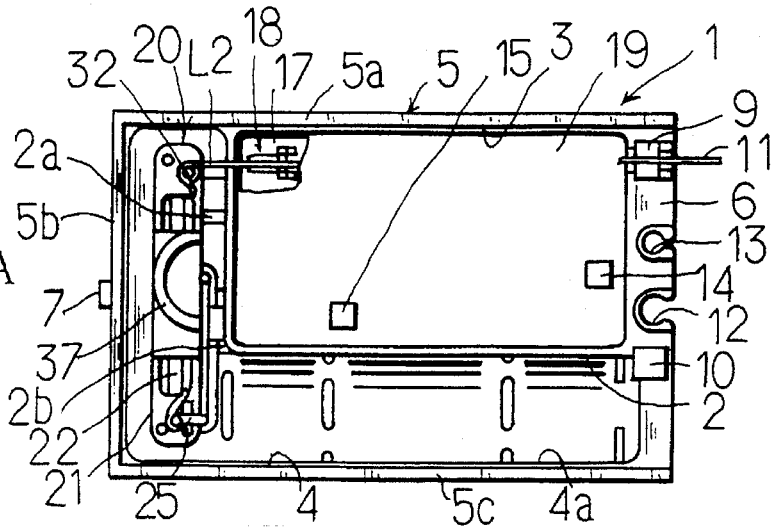
FIG. 1A is a bottom view showing an embodiment of a high-voltage electronic component according to the present invention which is embodied in the form of a high-voltage variable resistor unit.
Figure 1B:
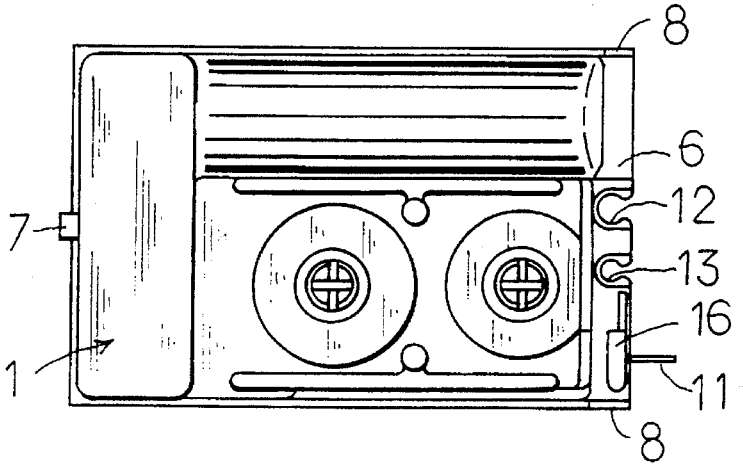
FIG. 1B is a plan view of the high-voltage electronic component shown in FIG. 1A.
Figure 1C:
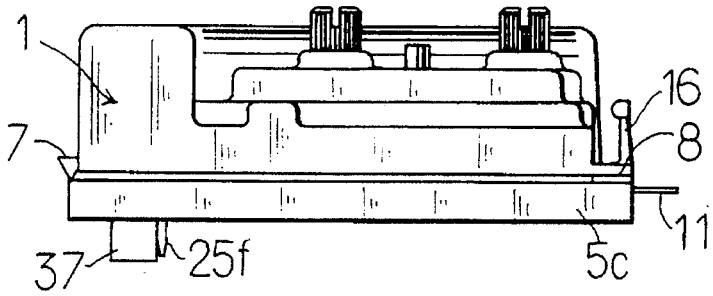
FIG. 1C is a side elevation view of the high-voltage electronic component shown in FIG. 1A.
Figure 1D:
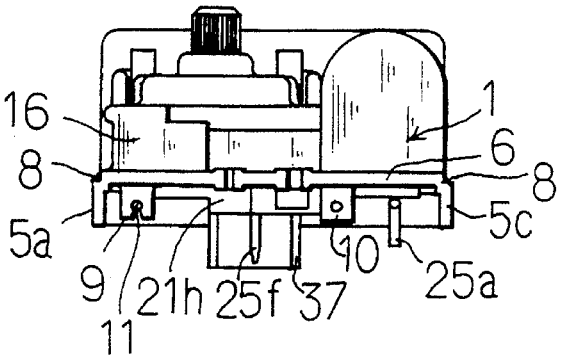
FIG. 1D is a front elevation view of the high-voltage electronic component shown in FIG. 1A.

Now, a high-voltage electronic component according to the present invention will be described hereinafter with reference to the accompanying drawings.

Referring first to FIGS. 1A to 1D, an embodiment of a high-voltage electronic component according to the present invention is illustrated, which is embodied in the form of a high-voltage variable resistor unit. A high-voltage variable resistor unit of the illustrated embodiment is adapted to be mounted on a transformer casing of a fly-back transformer so as to close or cover a variable-resistor-mounting opening of the transformer casing or an opening of the transformer casing through which the high-voltage variable resistor unit is mounted on the transformer casing. The transformer casing may be formed of a synthetic resin material. After the resistor unit is mounted on the transformer casing, an insulating resin material for molding of the transformer is charged in a region extending from an insulating resin charging opening of the transformer casing through an interior of the transformer casing to an opening formed at a rear surface of the high-voltage variable resistor unit. To this end, the high-voltage variable resistor unit includes an insulating casing 1 which is formed into a hollow shape and in a one-side-open manner of providing at a bottom side of the casing 1 with an opening. The insulating casing 1 is formed therein with a substrate receiving chamber 3 and an attachment receiving chamber 4 which are separated from each other through a partition 2. The insulating casing 1 is integrally formed of a synthetic resin material such as polyethylene terephthalate, Noryl (trademark) resin or the like.

The insulating casing 1 is provided with a fit-on wall section 5, which is formed into a substantially U-shape so as to define an internal space of the hollow insulating casing 1. Thus, the fit-on wall section 5 is arranged so as to extend along a whole circumference of the opening, except a side thereof facing the insulating resin charging opening of the transformer casing when it is mounted on the transformer casing. The side of the insulating casing 1 facing the insulating resin charging opening of the transformer casing is formed with a flat-plate section 6 so as to be integral with the insulating casing 1.

The fit-on wall section 5 includes a first wall portion 5*a* and a third wall portion 5*c* arranged on both side ends of the flat-plate section 6 so as to interpose the flat-plate section 6 therebetween and a second wall portion 5*b* arranged in a manner to be spacedly opposite to an inner surface of the flat-plate section 6. The second wall portion 5*b* is mounted on an outer surface thereof with a projection 7 for reinforcement so as to outwardly project therefrom. The reinforcement projection 7 is adapted to be engaged with a reinforcement recess formed on a rising wall which forms a fitment groove defined so as to surround the variable-resistor-mounting opening of the transformer casing, to thereby prevent one end of the insulating casing from being raised when the transformer casing is charged with a thermosetting insulating resin material. The first and third wall portions 5*a* and 5*c* of the fit-on wall section 5 each are formed on an outer surface of an end thereof positioned on the side of the flat-plate section 6 with a step 8 for engagement. The engagement steps 8 each are adapted to be engaged with an engagement projection integrally formed on the above-described rising wall which defines the fitment groove surrounding the variable-resistor-mounting opening of the transformer casing, to thereby prevent the other end of the insulating casing 1 from being lifted.

The flat-plate section 6, as shown in FIG. 1A, is integrally mounted on a bottom end surface thereof with a terminal holding portion 9 and a lead wire holding portion 10. The terminal holding portion 9 is formed so as to permit a terminal 11 to be securely held therein by press fitting. The lead wire holding portion 10 is formed with a through-hole into which an output pin for connecting a lead wire of a capacitor C (FIG. 2) thereto is inserted. Also, the flat-plate section 6 is formed on an outer surface thereof with elongated through-holes 12 and 13 of a C-like shape in cross section so as to vertically extend between the bottom end of the section 6 and a top end thereof. The C-shaped through-holes 12 and 13 function to guide two high-voltage lead wires or a first high-voltage lead wire for screen voltage outputting and a second high-voltage lead wire for focus voltage outputting, respectively. More particularly, the first lead wire is connected to a terminal fitment 14 and then led out via the through-hole 13 to the outer surface of the flat-plate section 6 and the second lead wire is connected to a terminal fitment 15 and then led out via the through-hole 12 to the outer surface of the flat-plate section 6. The two high-voltage lead wires thus lead out to the outer surface of the flat-plate section 6 are then bent so as to extend along the outer surface of the flat-plate section 6, followed by being pressedly fitted between an outer surface of the insulating casing 1 and a holding element 16 provided on the flat-plate section 6.

Figure 2:
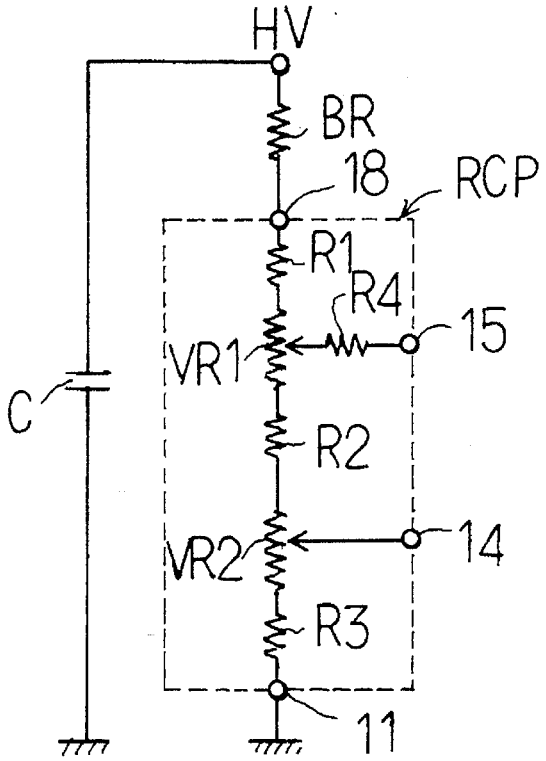
FIG. 2 is a circuit diagram of the high-voltage electronic component shown in FIGS. 1A to 1D.

The terminal 11 and the terminal fitments 14 and 15 are fixedly mounted on a rear surface of an insulating substrate 17 made of a ceramic or porcelain material and arranged in the substrate receiving chamber 3 of the insulating casing 1. The insulating substrate 17 is formed on a front surface thereof with a resistance pattern for a variable resistor which includes a variable resistance element for the focus voltage outputting and a variable resistance element for the screen voltage outputting. The insulating substrate 17 is also securely mounted on the rear surface thereof with a terminal fitment 18 for an input terminal, which will be described hereinafter. A circuit of the resistance pattern formed on the insulating substrate 17 is indicated by reference character RCP in FIG. 2 which is a circuit diagram of the high-voltage variable resistor unit of the illustrated embodiment. In FIG. 2, reference character C designates the capacitor as described above.

Between the insulating substrate 17 and an upper wall of the insulating casing 1 are received a rotor for focusing and a rotor for screening each including a contact contacted with the resistance pattern. The insulating substrate 17 is charged on the rear side thereof with a thermosetting insulating resin material such as epoxy resin for the purpose of enhancing insulation of the insulating substrate and protecting it. The insulating resin charged is cured by heating, to thereby provide an insulating resin layer 19. In FIG. 1A, the insulating resin layer 19 is partially cut away for the purpose of clarify a relationship between a structure of the terminal fitment 18 and a lead wire L2 extending from a high-voltage fixed resistor 20.

Figure 3A:
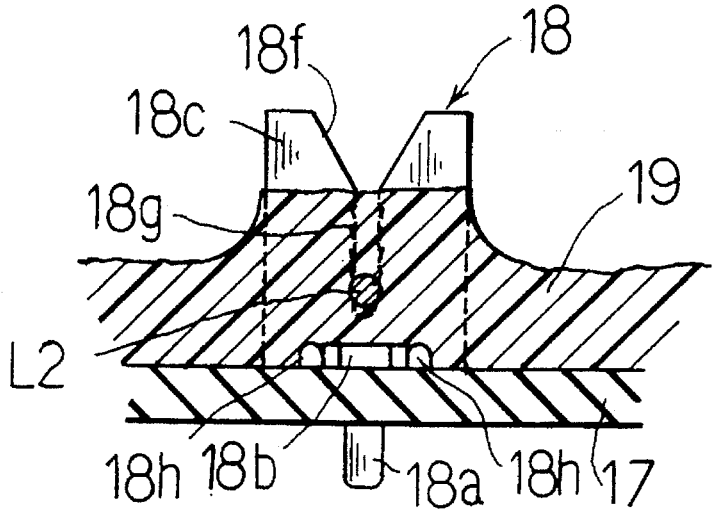
FIGS. 3A and 3B each are a fragmentary schematic sectional view showing a terminal fitment and a lead wire which are embedded in an insulating resin layer.
Figure 3B:
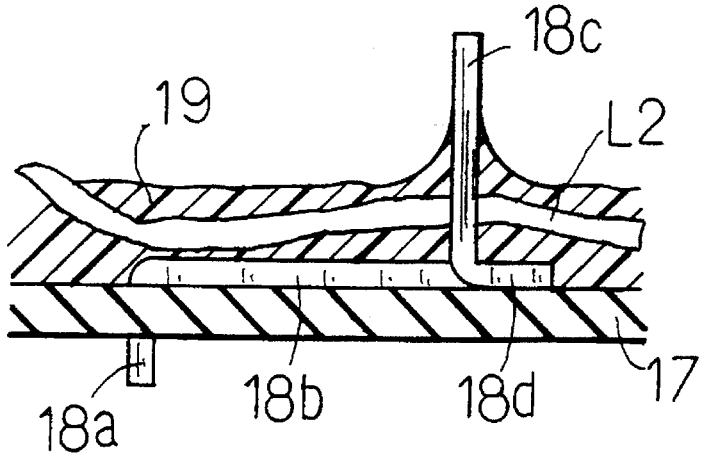
Figure 3C:
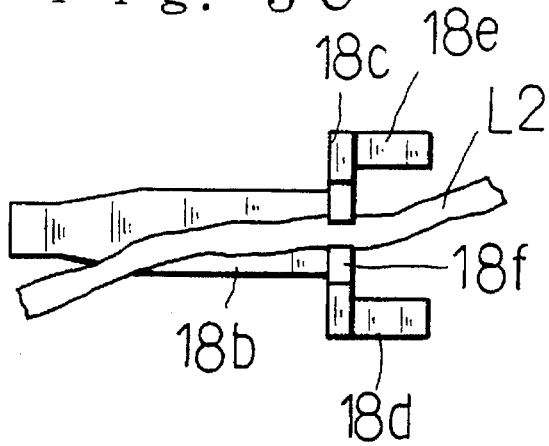
FIG. 3C is a fragmentary schematic view showing a terminal fitment and a lead wire prior to charging of insulating resin.

Now, a structure for connection between the terminal fitment 18 and the lead wire L2 will be described hereinafter with reference to FIGS. 3A to 3C, wherein FIGS. 3A and 3B each show the terminal fitment 18 embedded in the insulating resin layer 19 and FIG. 3C shows the terminal fitment 18 prior to charging of the insulating resin. The terminal fitment 18 includes a connection 18*a* extending through the insulating substrate 17, an extension 18*b* extending from the connection 18*a* along the rear surface of the insulating substrate 17, a lead wire connection 18*c* extending from the extension 18*b* in a direction downwardly away from the insulating substrate 17, and a pair of reinforcements 18*d* and 18*e* each extending from each of both sides of a proximal portion of the lead wire connection 18*c* in a direction horizontally away from the extension 18*b* and along the rear surface of the insulating substrate 17. The connection 18*a* is joined, by soldering, to an electrode formed on the front surface of the insulating substrate 17. The connection 18*a* and extension 18*b* cooperate with each other to provide a terminal section.

The lead wire connection 18*c* is formed into a plate-like shape and provided with a groove in a manner to extend from a distal end thereof toward the extension 18*b* or insulating substrate 17, resulting in providing a lead-wire inlet 18*f* of an inverted frust-conical shape and a lead-wire press-fit channel 18*g* contiguous to the inlet 18*f* which are arranged in order from the distal end of the connection 18*c* toward the insulating substrate 17. The press-fit channel 18*g*, as shown in FIG. 3A, is formed into an elongated shape in section so that one end thereof communicates with the lead-wire inlet 18*f* and the other end thereof terminates at a proximal portion of the lead-wire connection 18*c*. The press-fit channel 18*g* is formed on a surface thereof with a sawtooth-like roughness which functions to securely hold the lead wire L2 in the channel 18*g*. The press-fit channel is so formed that the narrowest portion thereof has a width smaller than a diameter of the lead wire L2 and the widest portion thereof has substantially the same as the diameter of the lead wire L2.

Press fitting of the lead wire L2 in the press-fit channel 18*g* is carried out by inserting the lead wire L2 through the lead-wire inlet 18*f*. The lead-wire inlet 18*f* is formed into a width larger than that of the press-fit channel 18*g*, so that insertion of the lead wire into the press-fit channel 18*g* may be facilitated. Upon press-fitting of the lead wire in the press-fit channel 18*g*, the insulating resin is charged through the opening of the insulating casing 1 in the substrate receiving chamber 3 to form the insulating resin layer 19. The lead wire L2 is preferably embedded at one end thereof in the insulating resin layer 19. When the lead wire L2 is press-fitted in the press-fit channel 18*g* while grasping the lead-wire connection 18*c* of the terminal fitment, force which acts to incline the lead-wire connection 18*c* is applied thereto. Nevertheless, in the illustrated embodiment, the reinforcements 18*d* and 19*e* are arranged so as to extend away from the extension 18*b*, so that a reinforcing action of the reinforcements 18*d* and 18*e* prevents from the force from substantially inclining the lead-wire connection 18*c*.

In the illustrated embodiment, the lead-wire inlet 18*f* is positioned at the distal end of the lead-wire connection 18*c* to permit the lead wire L2 to be inwardly inserted through the lead-wire inlet 18*f* into the press-fit channel 18*g*. Alternatively, the illustrated embodiment may be so constructed that the lead-wire inlet 18*f* is arranged on a side end of the lead-wire connection 18*c*, to thereby permit the lead wire to be laterally inserted through the lead-wire inlet 18*f*. In this instance, the press-fit channel 18*g* may be formed so as to further laterally extend from the lead-wire inlet 18*f*.

Also, in the illustrated embodiment, the lead-wire inlet 18*f* is formed so as to be open on an end surface of the lead-wire connection 18*c*. Alternatively, it may be arranged in the form of a hole which is not open on the end surface of the lead-wire connection 18*c*. In this instance, the lead wire L2 is inserted at one end thereof through the lead-wire inlet 18*g* in a manner like that of threading a needle and then press-fitted in the press-fit channel 18*g*.

The illustrated embodiment may be free of the lead-wire inlet 18*f*. In this instance, the press-fit channel 18*g* is formed at the lead-wire connection 18*c* so as to inwardly extend from the surface of the connection 18*c* thereinto. The press-fit channel 18*g* is formed so as to be open on a vertical surface of the lead-wire connection 18*c* or a horizontal surface thereof.

The high-voltage fixed resistor 20 shown in FIG. 1 constitutes a top bleeder resistance BR shown in FIG. 2 which acts as a fixed resistor. The high-voltage fixed resistor 20 is constructed described hereinafter and received in an inverted manner in the attachment receiving chamber 4 of an L-like shape.

Now, the high-voltage fixed resistor 20 will be more detailedly described hereinafter with reference to FIGS. 4A to 4D which are a plan view of the resistor 20, a side elevation view thereof, a front elevation view thereof and a bottom view thereof, respectively.

The high-voltage fixed resistor 20 includes a holder 21 made of an insulating resin material into a hollow shape and a resistance-formed substrate or second substrate 22 received in the holder 21. The resistance-formed substrate includes a substrate made of a ceramic material and a resistance pattern (not shown) for a fixed resistor formed on a front surface of the substrate and including a pair of electrodes, to which first and second lead wires L1 and L2 are connected, respectively. The holder 21 includes a holder body 21*a* which is formed into a hollows shape and provided on a bottom side thereof with an opening, through which the resistance-formed substrate 22 is received in the holder body 21*a*. The holder body 21*a* includes first and third walls 21*b* and 21*d* each arranged so as to be opposite to a surface of the resistance-formed substrate 22 and spaced at a predetermined interval therefrom, as well as second and fourth walls 21*c* and 21*e* each arranged so as to connect opposite ends of the walls 21*b* and 21*d* to each other therethrough. Also, the holder body 21*a* includes a top wall provided with first and second lateral sections 21*f* and 21*g* and a curved cover 21*h* formed into an upwardly projected C-like shape and arranged so as to cover a central portion of the top wall.

In the illustrated embodiment, as briefly described above, the resistor 20 is received in the insulating casing through the opening of the insulating casing while being inverted as will be noted from FIG. 1A. Thus, the top wall of the holder body 21*a* can be called a wall of the holder body 21*a* facing the opening of the insulating casing when the resistor 20 is received in the casing 1. Thus, the top wall is also referred to as an "opening facing wall" herein.

The first wall 21*b* of the holder body 21*a* is provided on an outer surface thereof with hooks 23 and 24, which are adapted to be engagedly fitted in the recesses 2*a* and 2*b* for engagement provided on the partition 2 of the insulating casing 1. The hooks 23 and 24 are provided with projections 23*a* and 24*a* outwardly projected therefrom, respectively, which serve to prevent engagement between the first wall 21*b* and the partition 2 of the insulating casing 1 through the hooks 23 and 24 and recesses 2*a* and 2*b* from being loosened, to thereby render the engagement firm.

Figure 5:
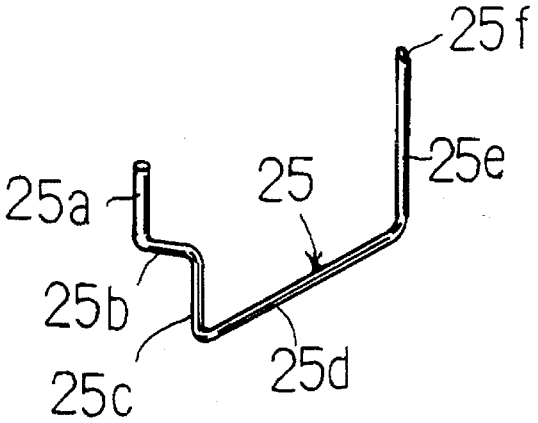
FIG. 5 depicts a wire-like terminal of the invention.

Reference numeral 25, as shown in FIG. 5, designates a wire-like terminal which provides a means for electrically connecting an output terminal provided on a side of the fly-back transformer and the first lead wire L1 acting as an input of the high-voltage resistor 20 to each other. The wire-like terminal 25 is formed by bending a metal wire which is bendable and has a degree of rigidity, such as, for example, a piano wire. The wire-like terminal 25, as shown in FIG. 5, includes a connection terminal portion 25*a* formed so as to rise on the holder 21, a first fitted portion 25*b* connected at one end thereof to one end of the connection terminal portion 25*a* so as to extend in a direction perpendicular thereto and along the lateral section 21*f* of the top wall of the holder body 21*a*, a second fitted portion 25*c* connected at one end thereof to the other end of the first fitted portion 25*b* so as to extend in a direction perpendicular thereto and along the first wall 21*b* of the holder body 21*a*, a third fitted portion 25*d* connected at one end thereof to the other end of the second fitted portion so as to extend in a direction perpendicular thereto and along the wall 21*b* of the holder body 21*a*, and a fourth fitted portion 25*e* connected at one or proximal end thereof to the other end of the third fitted portion 25*d* so as to extend in a direction perpendicular thereto and provided at the other or distal end thereof with a needle-like connection 25*f*. The connection 25*f* is adapted to be inserted into an electrically conductive rubber terminal provided on a side of the fly-back transformer.

The first wall 21*b* of the holder body 21*a* is provided on an outer surface of an upper portion thereof with first and second discrete fitting members 26 and 27 in a manner to be positionally separated from each other, in which the wire-like terminal 25 is fittedly received. Also, a third discrete fitting member 28 is arranged on the first lateral section 21*f* of the top wall of the holder body 21*a*. Thus, it will be noted that the third discrete fitting member 28 is arranged in a manner to be positionally separated from the first and second discrete fitting members 26 and 27. The third discrete fitting member 28 includes a pair of opposite elements between which the first fitted portion 25*b* of the wire-like terminal 25 is fittedly held. The first discrete fitting member 26 is formed into a pocket-like shape in a manner to be open at an upper end thereof and at one of side ends thereof, so that a space or gap is formed between the first wall 21*b* of the holder body 21*a* and an inner surface of the first discrete fitting member 26. Also, the first discrete fitting member 26 is formed at a bottom thereof with a slit 26*a* for promoting distribution of the insulating resin in the member 26 and/or charging of the resin therein. The first discrete fitting member 26 is fitted therein with the second fitted portion 25*c* of the wire-like terminal 25, as well as a part of the third fitted portion 25*d* of the terminal 25. The second discrete fitting member 27 is likewise formed into a pocket-like shape in which an upper end thereof and one of side ends thereof are open, so that a space or gap is formed between the first wall 21*b* and an inner surface of the second discrete fitting member 27. Also, the second discrete fitting member 27 is formed so as extend to the curved wall 21*h* of the holder body 21*a*. The second discrete fitting member 27 thus formed is fitted therein with a part of the third fitted portion 25*d* of the wire-like terminal 25 and the fourth fitted portion 25*e* of the terminal 25. The space or gap between the first wall 21*b* of the holder body 21*a* and each of the first and second discrete fitting members 26 and 27 is partially or wholly formed into a dimension smaller than a diameter of the wire-like terminal 25. When the gap is formed at a part thereof into a dimension smaller than the diameter, at least one of the inner surface of the first or second discrete fitting member 26 or 27 and the first wall 21*b* may be provided thereon with a projection for adjusting the gap.

Figure 4A:
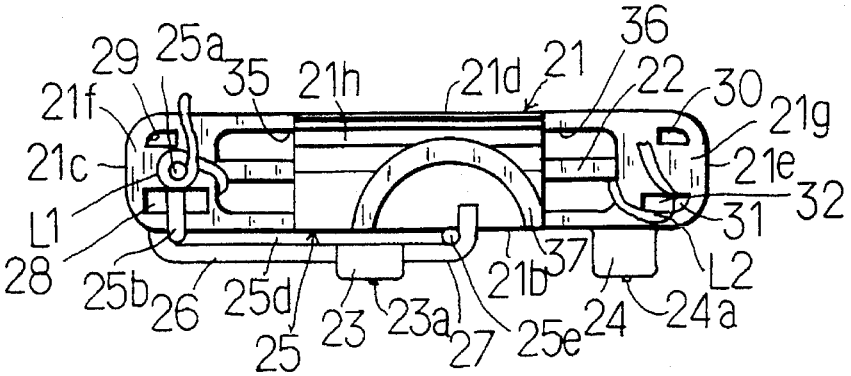
FIG. 4A is a plan view showing a high-voltage fixed resistor incorporated in the high-voltage electronic component shown in FIG. 1A in an inverted manner.
Figure 4B:
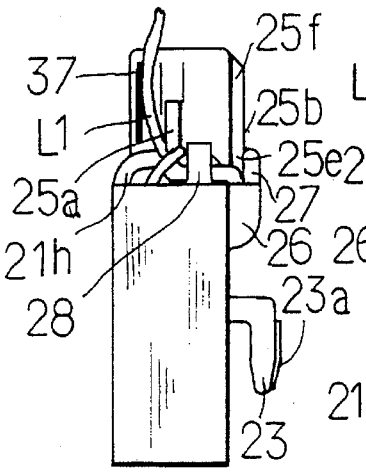
FIG. 4B is a side elevation view of the high-voltage fixed resistor shown in FIG. 4A.
Figure 4C:
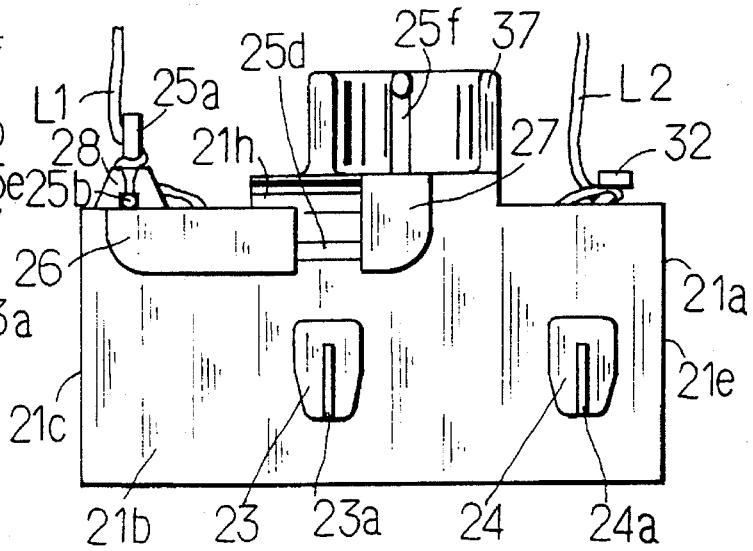
FIG. 4C is a front elevation view of the high-voltage fixed resistor shown in FIG. 4A.
Figure 4D:
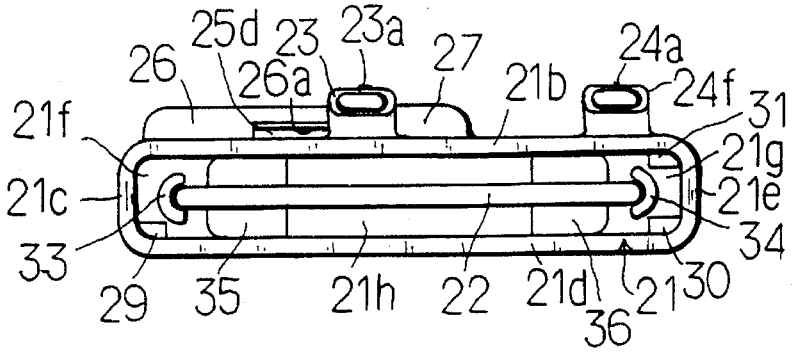
FIG. 4D is a bottom view of the high-voltage fixed resistor shown in FIG. 4A.

The first lateral section 21*f* of the top wall of the holder body 21*a* is formed with a through-hole 29 via which the insulating resin flows thereinto. The second lateral section 21*g* of the top wall is formed with two through-holes 30 and 31 via which the insulating resin is fed into the holder body 21*a*. Also, the second lateral section 21*g* is integrally mounted thereon with a hook-like holding member 32 on which the second lead wire L2 is heldly wound. In addition, the first and second lateral sections 21*f* and 21*g*, as shown in FIG. 4D, are provided on a lower surface thereof with sandwiching members 33 and 34, respectively, which cooperate with each other to securely sandwich the resistance element substrate 22 therebetween.

The top wall of the holder body 21*a* which is also referred to as the opening facing wall is formed with through-holes 35 and 36 via which the first and second lead wires L1 and L2 are led out of the holder 21. The first lead wire L1 is wound on the connection terminal portion 25*a* of the wire-like terminal 25 and then joined thereto by soldering. The connection terminal portion 25*a* is also connected thereto a lead wire of the capacitor C (FIG. 2) received in a capacitor receiving section 4*a* of the attachment receiving chamber 4. The second lead wire L2 is wound on the holding member 32 and then joined to the terminal fitment 18 as shown in FIG. 1A.

The curved wall 21*h* of the holder body 21*a* is provided thereon with a terminal guide 37 of a semi-cylindrical shape in a manner to be integral therewith. The terminal guide 37 is arranged so as to surround a half of the needle-like connection 25*f* of the wire-like terminal 25 and serves to guide the connection portion 25*f* when the connection 25*f* is inserted into the electrically conductive terminal arranged on the transformer casing of the fly-back transformer.

The high-voltage variable resistor unit of the illustrated embodiment is mounted through the opening thereof on the transformer casing of the fly-back transformer and then charged with the insulating resin for molding of the fly-back transformer. The insulating resin is also charged in the holder 21 via the through-holes 29 to 31 and 35 and 36 of the holder body 21*a*.

The high-voltage fixed resistor 20 incorporated in the high-voltage variable resistor unit of the illustrated embodiment is so constructed that the first to third discrete fitting members 26 to 28 are arranged on the first wall 21*b* and the top wall or opening facing wall of the holder body 21*a* perpendicular to the first wall 21*b* in a manner to be positionally separated from each other, so that the wire-like terminal 25 may be kept at a desired posture by merely fittedly holding the wire-like terminal 25 in the discrete fitting members 26 to 28. Thus, the discrete fitting members 25 to 28 are arranged on the different walls of the holder body, so that the wire-like terminal 25 may be held on the holder body while straddling a corner defined between the walls, to thereby be firmly held on the holder body.

In the illustrated embodiment, it is a matter of course that a conventional high-voltage fixed resistor may be conveniently used. Also, the high-voltage variable resistor unit of the illustrated embodiment is so constructed that the attached electronic component such as a capacitor or the like as well as the high-voltage fixed resistor is received in the insulating casing. However, the present invention is not limited to such construction wherein the attached electronic component is received in the insulating casing. The present invention can be directed to other applications so long as the lead wires are connected to the terminal fitment. Further, the foregoing description has been made on a combination of the high-voltage variable resistor unit with the transformer casing of the fly-back transformer, however, the present invention is not restricted to such combination. Moreover, the above description is directed to the structure of connection of the lead wire to the high-voltage variable resistor unit, however, the present invention may be conveniently applied to a high-voltage electronic component other than the high-voltage variable resistor unit exemplified above.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise as specifically described.

What is claimed is:

1. A high-voltage electronic component comprising:

an insulating substrate having a front surface and a rear surface and formed on said front surface thereof with a circuit pattern;

a one-side-open insulating casing of a hollow shape which is formed on one side thereof with an opening;

said insulating substrate being received in said insulating casing in such a manner that said rear surface of said insulating substrate faces said opening of said insulating casing;

an insulating resin layer formed on said rear surface of said insulating substrate received in said insulating casing; and a terminal fitment fixed on said rear surface of said insulating substrate and electrically connected to said circuit pattern;

said terminal fitment being formed with a press-fit channel in which a lead wire is press-fitted at an end thereof;

said end of said lead wire being embedded in said insulating resin layer while being kept press-fitted in said press-fit channel.

2. A high-voltage electronic component as defined in claim 1, wherein said press-fit channel is formed on a surface thereof with a sawtooth-like roughness for holding said lead wire in said press-fit channel by engagement with said lead wire.

3. A high-voltage electronic component as defined in claim 1, wherein said terminal fitment includes a lead-wire connection of a plate-like shape formed with said press-fit channel and a terminal section including a connection connected to said circuit pattern;

said lead-wire connection being formed with a lead-wire inlet in a manner to extend from an outer surface thereof to said press-fit channel;

said lead-wire inlet being tapered off in section.

4. A high-voltage electronic component as defined in claim 3, wherein said lead-wire inlet is formed so as to extend from a first portion of said outer surface of said lead-wire connection opposite to a second portion of said outer surface facing said rear surface of said insulating substrate to said press-fit channel and said press-fit channel is formed into an elongated shape in section so as to extend toward said second portion of said outer surface of said lead-wire connection.

5. A high-voltage electronic component as defined in claim 3, wherein said terminal section of said terminal fitment further includes an extension arranged so as to extend along said rear surface of said insulating substrate between said connection and said lead-wire connection.

6. A high-voltage electronic component as defined in claim 5, wherein said terminal fitment further includes a reinforcement arranged so as to extend in a direction opposite to said terminal section and contacted with said rear surface of said insulating substrate.

7. A high-voltage variable resistor unit comprising:

an insulating substrate having a front surface and a rear surface and formed on said front surface thereof with a circuit pattern including a resistance element for a variable resistor;

a one-side-open insulating casing of a hollow shape which is formed on one side thereof with an opening;

said insulating casing being formed therein with a substrate receiving chamber in which said insulating substrate is received in such a manner that said rear surface of said insulating substrate faces said opening of said insulating casing and an attachment receiving chamber in which an attached component is received;

an insulating resin layer formed on said rear surface of said insulating substrate received in said insulating casing; and a terminal fitment fixed on said rear surface of said insulating substrate and electrically connected to said circuit pattern;

said terminal fitment being formed with a press-fit channel in which a lead wire connected to said attached component is press-fitted at an end thereof;

said end of said lead wire being embedded in said insulating resin layer while being kept press-fitted in said press-fit channel.

8. A high-voltage variable resistor unit as defined in claim 7, wherein said attached component is received in said attachment receiving chamber while being held in a holder;

said holder being provided with a holding member in a manner to be integral therewith;

said lead wire being held on said holding member.

9. A high-voltage variable resistor unit as defined in claim 7 or 8, wherein said press-fit channel is formed on a surface thereof with a sawtooth-like roughness for holding said lead wire in said press-fit channel by engagement with said lead wire.

10. A high-voltage variable resistor unit as defined in claim 8, wherein said terminal fitment includes a lead-wire connection of a plate-like shape formed with said press-fit channel and a terminal section including a connection connected to said circuit pattern;

said lead-wire connection being formed with a lead-wire inlet in a manner to extend from an outer surface thereof to said press-fit channel;

said lead-wire inlet being tapered off in section;

said lead-wire inlet and press-fit channel being formed so as to extend toward said holding member of said holder.

* * * * *